United States Patent [19]

Zenkich

[11] 4,390,223

[45] Jun. 28, 1983

[54] ELECTRICAL CONNECTOR

[75] Inventor: Ilias R. Zenkich, Norridge, Ill.

[73] Assignee: Zenex Corporation, Chicago, Ill.

[21] Appl. No.: 197,485

[22] Filed: Oct. 16, 1980

[51] Int. Cl.[3] ..... H01R 13/48

[52] U.S. Cl. ..... 339/61 R; 339/200 P; 339/260

[58] Field of Search ..... 339/61, 200 P, 255 P, 339/260, 261

[56] References Cited

U.S. PATENT DOCUMENTS

| | | | |
|---|---|---|---|
| 910,842 | 1/1909 | McIntyre | 339/261 |
| 1,701,387 | 2/1929 | Rabezzana | 339/261 |
| 2,103,891 | 12/1937 | Brown . | |
| 2,112,680 | 3/1938 | Sambleson . | |
| 2,248,718 | 7/1941 | Owen . | |
| 3,624,590 | 9/1968 | Bolduc . | |
| 3,651,447 | 3/1972 | Branco et al. . | |
| 3,740,703 | 6/1973 | Lessions | 339/261 |
| 3,774,143 | 11/1973 | Lopin . | |
| 3,914,007 | 10/1975 | Seidler | 339/255 P |
| 4,178,052 | 12/1979 | Ekbom | 339/261 |

FOREIGN PATENT DOCUMENTS

| | | | |
|---|---|---|---|
| 414326 | 7/1946 | Italy | 339/255 P |

*Primary Examiner*—Joseph H. McGlynn
*Attorney, Agent, or Firm*—Wood, Dalton, Phillips, Mason & Rowe

[57] ABSTRACT

An electrical connector for a cable and an electrode assembly having a resilient electrical conducting wire with two ends and an expandable polygonal loop therebetween with the ends of the conducting wire embedded in a handle assembly composed of two handles with a loop circumscribing hinge therebetween. An electrically conducting cable is connected with one of the conductor wire ends within one of the handles and has a plug on the other end for insertion into a monitoring instrument jack. The connection of the cable to the electrode is accomplished by movement of the handles of the electrical connector toward one another which expands the loop so as to fit over the electrode and release of the handles causing the loop to contract and engage the electrode.

6 Claims, 3 Drawing Figures

ELECTRICAL CONNECTOR

BACKGROUND OF THE INVENTION

1. Field of the Invention

This invention relates to electrical connectors and more particularly to electrical connectors of the type used in the medical industry to transmit physiological data to a monitoring instrument.

2. Description of the Prior Art

With the introduction of electronic monitoring instruments into the medical profession a demand was created for devices which could easily connect the remote monitoring instrument to the physiological signal producing electrodes attached to the patient. In response to this demand, a multitude of electrical connectors of diverse types have been developed. One type of the aforementioned connectors connects the monitoring instrument to the patient by snapping onto the electrode. These connectors are pressed onto the electrode and snappingly clipped onto a reduced neck portion of the electrode.

A second type of connector provided for the clipping onto the electrode by the use of a scissor motion and is best represented by the Lopin U.S. Pat. No. 3,774,143. The Lopin electrical adaptor consists of a conducting wire formed so as to have a pair of parallel opposing jaws which are contained within a pair of arms having a biasing hinge therebetween. In addition to the foregoing, the Lopin electrical connector has a cap which fits into the handle assembly to protect the conductor wire. The connectors such as Lopin are connected to the electrodes by squeezing the arms together against the bias of the hinge which in turn opens the jaws to allow the electrode to pass through. The handles are then released causing the jaws to contract and clasp the electrode.

In manufacture and use, the above connectors have various shortcomings. The snap-on connector requires a downward force against the electrode and ultimately the patient to snap the connector thereon. This downward force can result in patient discomfort and possibly electrode damage. Furthermore, the snap-on connector can not be easily removed from the electrode without pulling the electrode away from the body of the patient. The hinge connector such as Lopin requires numerous manufacturing steps to construct which add to the cost of the connector. These manufacturing steps include the bending of the conductor wire, soldering the cable end to the conductor wire, embedding the above into the arm structure of the connector, molding the cap and connecting the cap to the arm structure. Another drawback of the Lopin electrical adaptor is that its structure may interfere with the pivoting of the connector about the electrode which is often necessary for the proper placement of the cables. Under certain conditions, i.e., a large electrode or the operation of the connector in a wet environment, the electrode in the opposing jaws of Lopin may migrate so as to abut the sides of the bore which holds the jaws. This would result in the electrode being contacted by not only the jaws but also by the bore surface. The bore surface-electrode contact increases the friction between the connector and the electrode thereby hindering the pivoting of the connector about the electrode.

It is a primary object of the present invention to provide an electrical connector-electrode assembly that overcomes the problems noted in the prior art above.

SUMMARY OF THE INVENTION

In accordance with the present invention, an electrical connector is provided which is of simple manufacture, can easily clasp and be removed from an electrode and has characteristics which allow the connector to pivot about the electrode with a minimum of hindrance.

Toward this end the connector of this invention is provided with a single piece of resilient electrically conducting wire having two ends and a polygonal loop therebetween. The polygon whose perimeter is defined by the loop, is of such a size as to fit over the electrode only when the size of the loop is increased. Molded around the ends of the conductor wire are two non-conducting handles to insolate the ends of the wire and provide an operator gripping surface. Contemporaneous with the molding of the handles a hinge is formed which connects the handles, circumscribes the loop and provides a pivot point upon which the handles may hinge. Prior to the formation of the handles and hinge, the electrical cable which will transmit the electrical signal from the connector to the monitoring instrument is connected to one of the wire ends by means other than soldering and thereafter the connection is embedded within the body of one of the handles. Integrally formed with the handle assembly and formed from the same material as the handle is a biasing means which biases the handles apart to promote the spreading of the handles. This construction of the conducting wire and the handle assembly enables the size of the loop to be expanded simply by drawing the handles together against the resilience of the conductor wire and the biasing means. The loop is then placed over the electrode and the handles are released causing the handles to spread apart due to the resiliency of the conductor wire and the biasing means which in turn contracts the loop about the electrode.

Accordingly it is an object of this invention to provide an electrical connector which is of simple manufacture thereby promoting inexpensiveness. The invention uses only a length of resilient conducting wire and a one piece simultaneously formed handle assembly which includes a pair of handles, a hinge, a means to connect the cable to the conducting wire and a biasing means.

It is a further object to provide an electrical connector which can pivot about the electrode on which it is connected with a minimum of impedance. The four sided polygonal construction of the loop results in the electrode and loop contacting each other at only four points, one on each side of the polygon. A result of this point contact is a reduction in the friction between the electrical connector and the electrode which promotes the pivotability of the connector.

Further objects and advantages of this invention will become apparent from the study of the following portion of the specification, the claims and the attached drawings.

DESCRIPTION

Figure 1:
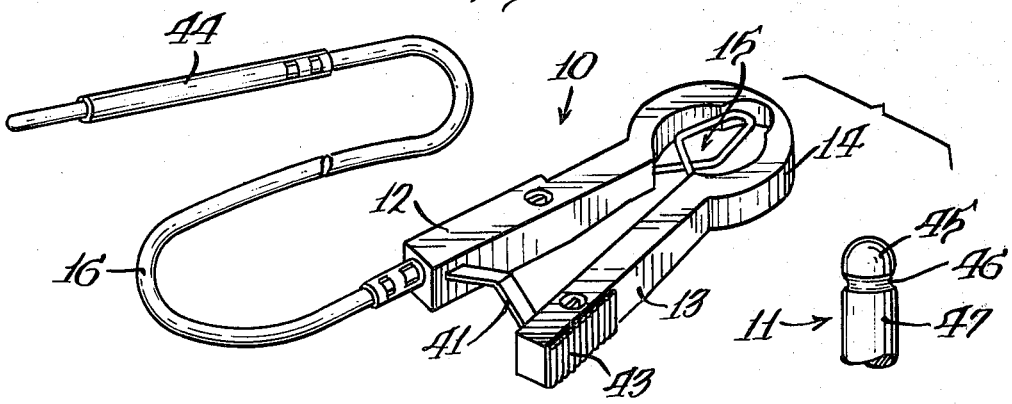
FIG. 1 is a perspective view of the electrical connector poised to engage the electrode.

Referring to the drawings and more particularly to FIG. 1, an electrical connector 10, according to the present invention, is shown poised to engage a stud-provided electrode 11. The electrical connector 10 consists primarily of a pair of handles 12 and 13, hinge 14, conductor wire 15, and electrical cable 16.

Figure 2:
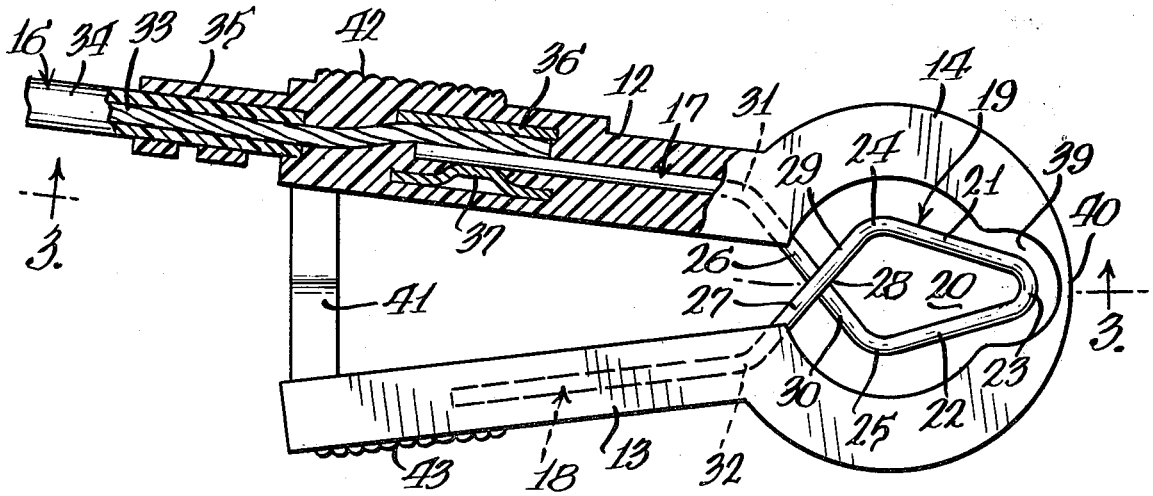
FIG. 2 shows a top view of the electrical connector with a portion cut away to illustrate the connection between the cable and the connector.

Viewing FIGS. 1 and 2 in more detail the conductor wire 15 is seen to be comprised of a resilient electrical conducting wire having two ends 17 and 18 fashioned so as to have a loop 19 medially therebetween. The loop 19, as envisoned in the preferred embodiment, is constructed so as to form a polygonal four sided, four cornered passageway 20 through which the stud-provided electrode may pass. To create the polygonal passageway 20 the loop 19 is formed so as to define two pairs of wire segments. One pair of wire segments 21 and 22 of the loop 19 which contribute to the formation of the polygonal passageway 20 are of equivalent lengths and have a connecting bend 23 therebetween. As illustrated in FIG. 2, the wire segments 21 and 22 and the concomitant bend 23 form along their internal periphery two sides and a corner of the polygonal passageway 20. The corner angle of the polygonal passageway 20 formed by the bend 23 is, in the preferred embodiment, less than orthogonal. Formed at the ends of the first wire segments 21 and 22 opposed from the bend 23 is a pair of second bends 24 and 25. These second bends 24 and 25 constitute two more corners of the four sided, four cornered polygonal passageway 20. The angles formed by the second bends 24 and 25 should be equal and slightly larger than orthogonal. From the second bends 24 and 25 and extending away from the first wire segments 21 and 22 are the second pair of wire segments 26 and 27. These second wire segments 26 and 27 will form the remaining two sides and the final corner of the polygonal passageway 20. As can be seen in the drawings the interaction of the above described first wire segments 21 and 22, the bend 23 and the second bends 24 and 25 necessarily require that the second wire segments 26 and 27 cross one above the other at the juncture 28. A further result of the foregoing structure of the loop 19 having the first wire segments 21 and 22 and the second bends 24 and 25 of respectively equal lengths and equal angles is that the portions of the second wire segments 26 and 27 falling between the second bends 24 and 25 and the juncture 28 result in loop segments 29 and 30 having equal lengths. With the above description in mind, and viewing FIG. 2, the polygonal passageway 20 created by loop 19 is set forth. The polygonal passageway 20 has four sides which are the first wire segments 21 and 22 and the loop segments 29 and 30 and the four corners are shown to consist of bend 23, second bends 24 and 25 and juncture 28.

Figure 3:
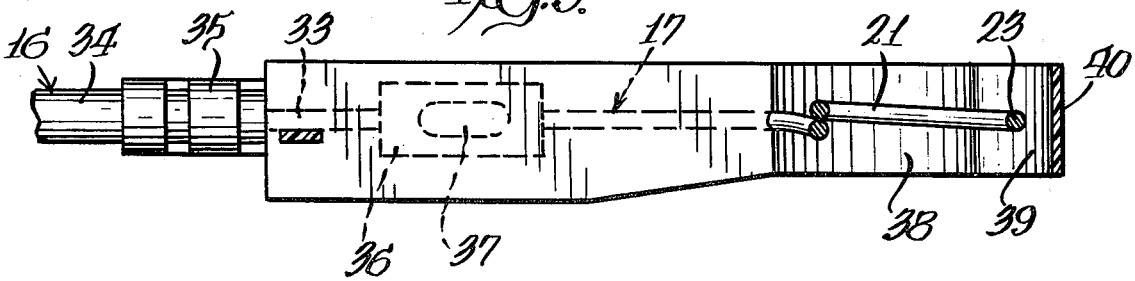
FIG. 3 is a section view of the electrical connector taken along line 3—3 of FIG. 2.

To enable an operator to non-conductively grip the conductor wire 15 to expand the loop 19 and the resultant polygonal passageway 20, the remaining lengths of the second wire segments 26 and 27, not defined as loop segments 29 and 30, engage the pair of handles 12 and 13. To accomplish the aforementioned the second wire segments 26 and 27, as shown in FIGS. 2 and 3, extend toward, engage and penetrate the handles 12 and 13 to approximately the handles 12 and 13 respective axes. Internal of the handles 12 and 13 the conductor wire bends forming essentially equivalent third bends 31 and 32 respectively. The wire ends 17 and 18, which represent the remaining lengths of the conductor wire 15, extend from the third bends 31 and 32, respectively, along the axes of the handles 12 and 13 and terminate therein. FIG. 2 illustrates that the third bends are such as to result in the wire ends 17 and 18 to be divergingly directed toward a common imaginary point which in lies the proximity of the loop 19. This arrangement of the wire ends 17 and 18 within the handles 12 and 13 enables the wire ends 17 and 18 to pivotally approach each other as the handles 12 and 13 are closed during the enlargement of the loop 19.

The handles 12 and 13 in which the wire ends 17 and 18 lie are divergingly cl-aligned with the wire ends 17 and 18. Structurally the handles are constructed from electrical insulating material and, in the preferred embodiment, approximate rectangular parallelepipeds having square cross-sections as shown in FIGS. 1-2. So constructed the handles 12 and 13, upon closure, pivot about the common imaginary point of the wire ends 17 and 18 and upon mutual contact are essentially parallel.

Individually, the handle 13 is so formed so as to completely envelop the wire end 18 and extend coaxially outward from said wire end 18 away from the loop 19 the purpose of which is to completely secure the wire end 18 therein and also to provide additional leverage for the closure of the handle 13. While the handle 12 is of similar construction to the handle 13, it is required to serve an additional function thereby necessitating certain structural dissimilarities. The additional function required of handle 12 is that of containing the means within its body to electrically connect the cable 16 to the wire end 17.

As shown in FIG. 2 the cable 16 to be attached to the wire end 17 is composed of an electrical conducting wire 33 surrounded by an insulating sheath 34 and has on one end a connecting plug 44 which can be inserted into a monitoring instrument jack. A portion of the wire 33 extends from without the sheath 34 for attachment to the wire end 17. To fashion this attachment the unsheathed portion of the wire 33 and the wire end 17 are inserted into the opposite ends of a conducting ferrule 36 so as to lie alongside each other. The ferrule 36 is then crimped, as shown by a depression 37, to forceably maintain the contact between the wire 33, wire end 17 and ferrule 36.

Once the above connection is made it will be implanted into the handle 12 upon formation thereof such that the cable 16 is attached to the end of the handle 12 which is directed away from the loop 19. In conjunction with the formation of the handle 12 a cylindrical cable support 35 will be molded. The cable support 35 serves not only to aid in the affixing of the electrical cable 16 to the handle 12 but also provides rigidity to the cable 16 necessary to prevent the electrical cable 16 from pulling out from the handle 12 or breaking due to the flexing of the electrical cable 16 at or near the receiving end of the handle 12. The electrical cable 16 also extends somewhat into the body of the handle 12 to provide further security for the electrical cable 16 and the handle 12 connection. The above construction of the conducting ferrule 36 being crimped to have a depression 37 results in a positive engagement of the cable wire 33 to the wire end 17 for the transmission of electrical impulses. The subsequent implantation of the ferrule 36 inside the handle 12 further secures the cable to handle 12. In addition to the above construction, the handles 12 and 13 are each provided with gripping surfaces 43 and 44 respectively. The gripping surfaces 42 and 43 consist of a multitude of small ridges which reduce the slippage between the handles 12 and 13 and the operator even in wet environment.

A hinge 14, molded concurrently with and from the same material as the handles 12 and 13, connects the end of handle 12 opposite the end receiving the cable 16 to the corresponding end of the handle 13 so as to encircle the loop 19. As can be seen in FIGS. 1 and 2 the hinge is generally disc shaped having a pair of adjoining axially parallel bores therethrough. The larger bore 38 is approximately coaxial to the hinge 14 and has a diameter such that the second bends 24 and 25 of the loop 19 will not be contacted by the sides of the larger bore 38 when the handles 12 and 13 are brought together. A smaller bore 39 is made through the hinge 14 parallel to and adjoining the larger bore 38 so as to assimilate a figure-8 void within the hinge 14. The smaller bore 39 has a diameter such that it may circumvent the bend 23 of the loop 19 and in no way interfere with the loop 19 as it is enlarged to receive the stud-provided electrode 11. As a result of the above construction of the hinge 14, a narrow pivot 40 is created in the hinge 14 between the edge of the smaller bore 39 and the outer edge of the hinge 14. The pivot 40, which approximates the common imaginary point to which the wire ends 17 and 18 and the handles 12 and 13 are directed, provides a point upon which the handles 12 and 13 pivotally hinge about during the closure and separation of the handles 12 and 13 required to connect the electrical connector 10 to the stud-provided electrode 11. In addition to providing a hinging means between the handles 12 and 13, the loop encircling hinge 14 provides protection for the loop 19 against damage or inadvertent contact by other electrical impulse producing sources.

To provide an additional biasing means to the bias already exhibited by the resilient conductor wire 15 and its concomitant loop 19 a biasing bridge 41, formed concurrently with and from the same material as the handles 12 and 13 and the hinge 14, is located between the cable receiving end of the handle 12 and the like end of the handle 13. The bridge 41 functions by buckling upon the closure of the handles 12 and 13 and, upon release of the handles 12 and 13, exerts a bias to force the handles 12 and 13 away from each other.

The stud-provided electrode 11 to which the electrical connector 10 will clasp is shown in FIG. 1 and is depicted as the type having a head 45 which reduces to form a neck 46 and then increases to form a stem 47 which is connected to an electrical impulse producing source (not shown). The electrical connector 10 of this invention, however, could equally be used on cylindrical or other electrodes of diverse shapes.

From the above, the connection of the electrical connector 10 to the stud-provided electrode can be accomplished. The handles 12 and 13 are held along their respective gripping surfaces 42 and 43 and the electrical connector 10 is brought to the proximity of the stud-provided electrode 11. The handles 12 and 13 are then brought towards one another against the bias of the resilient conductor wire 15 and the bridge 41 while hinging about the pivot 40. As the handles 12 and 13 move towards each other the loop segments 29 and 30 concurrently grow in length. The lengthening of the loop segments 29 and 30 cause the loop 19 and the attendant polygonal passageway 20 to expand. As the handles 12 and 13 abut each other the loop 19 and the polygonal passageway 20 acquires its maximum size. The loop 19 is fitted over the head of the stud-provided electrode 11 such that said head 45 passes through the polygonal passageway 20. When the loop 19 is adjacent to the neck 46 of the stud-provided electrode 11, the handles 12 and 13 are released. Due to the bias of the bridge 41 and the resiliency of the conductor wire 15, the handles spread apart and thereby reduce the size of the loop 19 and the resultant polygonal passageway 20. As the loop 19 engages the neck 46 the first wire segments 21 and 22 and the loop segments 29 and 30 of the loop 19 firmly contact the neck 46. Because the neck 46 is circular, the wire segments 21 and 22 and the loop segments 29 and 30 only contact the electrode 11 at four points, one point residing in each of the wire segments 21 and 22 and the loop segments 29 and 30. This contact between the loop 19 and the neck 46 is maintained due to the bias of the bridge 42 and the resiliency of the wire conductor 15. The electrical cable 16 is then connected to the appropriate monitoring instrument by insertion of the plug 44 into the appropriate jack thereby completing the circuit. Electrical impulses flow from the stud-provided electrode 11 through the loop 19, the wire end 17 of the conductor wire 15 and pass to the cable wire 33 which transmits the impulses along the cable 16 through the plug 44 into the monitoring machine. Should pivoting of the electrical connector 10 about the electrode 11 be required, the engagement of the electrode 11 by the loop 19 at only four distinct points restricts the frictional forces opposing such motion to these four points thereby minimizing the hindrance to such pivotal motion.

While I have shown and described certain embodiments of this invention, it is to be understood that it is capable of many modifications. Changes, therefore, in the construction and arrangement may be made without departing from the spirit and the scope of the invention as disclosed in the attached claims.

I claim:

1. An electrical connector between a stud-provided electrode having a reduced cross-section forming a neck and a cable comprising:

a resilient wire conductor having its ends crossed to form a loop;

a pair of electrical insulating handles attached one to each of said ends and having a hinge therebetween peripheral of said loop;

an electrical cable connected to one of said ends, whereby closure of said handles about said hinge enlarges the loop to allow the stud to pass therethrough and release of said handles causes said loop to contract about and grip said stud neck completing the electrical connection.

2. An electrical connector as described in claim 1 wherein the handles are attached to said ends so that said ends extend into and are surrounded by said handles.

3. An electrical connector as described in claim 2 wherein the electrical cable extends into one of said handles and is connected to said one end within said one handle.

4. An electrical connector as described in claim 3 wherein a biasing means is interconnected between said handles opposite to said hinge to bias said handles toward a loop closure position.

5. An electrical connector between a stud-provided electrode having a reduced cross-section forming a neck and an electrical cable which connects to a monitoring instrument, said electrical connector comprising:

a resilient wire conductor having two crossed ends and a polygonal loop therebetween;

a pair of electrical insulating handles one connected to and enveloping each of said wire ends;

an arcuate hinge interconnected between said handles peripheral of said loop;

a biasing means interconnected between said handles opposite of said hinge to bias said handles apart;

an electrical cable inserted into the end of one of said handles opposing the hinge so as to abut one of said wire ends;

a connection within said one handle to forcefully maintain the abutment between said cable and said one wire end and thereby electrically connect said cable and said one wire end;

whereupon closure of said handles causes said loop to enlarge to fit over said stud and release of said handles causes said handles to spread due to said resilient wire and said biasing means which in turn contracts said loop about said stud neck to complete the electrical connection between said cable and said electrode.

6. An electrical connector as in claim 5 wherein said connection means is a conductive ferrule contained within said one handle which has a depression therein which forcefully presses said cable to said wire one end.

* * * * *